US007726349B2

(12) United States Patent
Mullally et al.

(10) Patent No.: US 7,726,349 B2
(45) Date of Patent: Jun. 1, 2010

(54) TISSUE PRODUCTS HAVING HIGH DURABILITY AND A DEEP DISCONTINUOUS POCKET STRUCTURE

(75) Inventors: Cristina Asensio Mullally, Neenah, WI (US); Michael Alan Hermans, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 286 days.

(21) Appl. No.: 11/973,714

(22) Filed: Oct. 10, 2007

(65) Prior Publication Data

US 2008/0035288 A1 Feb. 14, 2008

Related U.S. Application Data

(60) Division of application No. 11/159,565, filed on Jun. 22, 2005, now Pat. No. 7,300,543, which is a continuation-in-part of application No. 10/745,184, filed on Dec. 23, 2003, now abandoned.

(51) Int. Cl.
*D21F 1/12* (2006.01)

(52) U.S. Cl. ..... 139/383 B; 139/383 R; 162/358.1; 162/902; 442/181; 442/192; 442/203; 442/208

(58) Field of Classification Search ..... 162/348, 162/358.1–358.4, 900–904; 139/383 B, 139/383 A, 383 AA, 383 R; 442/181, 192, 442/203, 208
See application file for complete search history.

(56) References Cited

U.S. PATENT DOCUMENTS

| | | | | | |
|---|---|---|---|---|---|
| 2,635,648 | A | * | 4/1953 | Foster | 428/175 |
| 3,553,065 | A | * | 1/1971 | Cavalier et al. | 428/113 |
| 3,553,066 | A | * | 1/1971 | Cavalier et al. | 428/172 |
| 3,879,257 | A | | 4/1975 | Gentile et al. | |
| 4,191,609 | A | | 3/1980 | Trokhan | |
| 4,759,391 | A | | 7/1988 | Waldvogel et al. | |
| 4,849,054 | A | | 7/1989 | Klowak | |
| 5,211,815 | A | * | 5/1993 | Ramasubramanian et al. | 162/348 |
| 5,228,482 | A | * | 7/1993 | Fleischer | 139/383 A |
| 5,240,763 | A | * | 8/1993 | Wagner et al. | 428/222 |
| 5,302,443 | A | | 4/1994 | Manning et al. | |
| 5,429,686 | A | | 7/1995 | Chiu et al. | |
| 5,456,293 | A | * | 10/1995 | Ostermayer et al. | 139/383 A |
| 5,520,225 | A | * | 5/1996 | Quigley et al. | 139/383 A |
| 5,542,455 | A | * | 8/1996 | Ostermayer et al. | 139/383 A |
| 5,593,545 | A | | 1/1997 | Rugowski et al. | |
| 5,607,551 | A | | 3/1997 | Farrington, Jr. et al. | |
| 5,672,248 | A | | 9/1997 | Wendt et al. | |
| 5,746,887 | A | | 5/1998 | Wendt et al. | |
| 5,853,547 | A | * | 12/1998 | Ahrens et al. | 162/348 |
| 6,017,417 | A | | 1/2000 | Wendt et al. | |
| 6,033,523 | A | | 3/2000 | Dwiggins et al. | |
| 6,165,319 | A | | 12/2000 | Heath et al. | |
| 6,368,454 | B1 | | 4/2002 | Dwiggins et al. | |
| 6,423,180 | B1 | | 7/2002 | Behnke et al. | |
| 6,558,511 | B2 | | 5/2003 | Dwiggins et al. | |
| 6,592,714 | B2 | | 7/2003 | Lamb | |
| 6,673,202 | B2 | | 1/2004 | Burazin et al. | |
| 6,706,152 | B2 | | 3/2004 | Burazin et al. | |
| 6,743,333 | B2 | * | 6/2004 | Lamb | 162/116 |
| 7,195,040 | B2 | * | 3/2007 | Ward | 139/383 A |
| 7,300,543 | B2 | * | 11/2007 | Mullally et al. | 162/109 |
| 7,445,032 | B2 | * | 11/2008 | Barrett et al. | 139/383 A |
| 7,493,923 | B2 | * | 2/2009 | Barrett et al. | 139/383 A |
| 2002/0088596 | A1 | * | 7/2002 | Lamb | 162/902 |
| 2002/0104630 | A1 | | 8/2002 | Dwiggins et al. | |
| 2002/0166601 | A1 | * | 11/2002 | Best | 139/383 R |
| 2003/0084953 | A1 | | 5/2003 | Burazin et al. | |
| 2003/0085010 | A1 | * | 5/2003 | Burazin et al. | 162/109 |
| 2003/0085013 | A1 | * | 5/2003 | Burazin et al. | 162/289 |
| 2003/0118847 | A1 | | 6/2003 | Chuang et al. | |
| 2003/0136529 | A1 | * | 7/2003 | Burazin et al. | 162/109 |
| 2003/0157300 | A1 | | 8/2003 | Burazin et al. | |
| 2004/0035541 | A1 | * | 2/2004 | Lamb | 162/348 |
| 2004/0055694 | A1 | | 3/2004 | Kershaw et al. | |
| 2005/0045293 | A1 | | 3/2005 | Hermans et al. | |
| 2005/0067039 | A1 | * | 3/2005 | LaFond et al. | 139/383 A |
| 2005/0133175 | A1 | | 6/2005 | Hada et al. | |
| 2005/0136222 | A1 | | 6/2005 | Hada et al. | |
| 2005/0236122 | A1 | * | 10/2005 | Mullally et al. | 162/109 |
| 2008/0035288 | A1 | * | 2/2008 | Mullally et al. | 162/109 |
| 2008/0110591 | A1 | * | 5/2008 | Mullally et al. | 162/358.2 |

(Continued)

FOREIGN PATENT DOCUMENTS

EP 0 839 955 A2 5/1998

(Continued)

OTHER PUBLICATIONS

"Digital Surf," Internet web page http://www.digitalsurf.fr/en/index.html, viewed and printed prior to Jun. 2005, 1 page.

(Continued)

*Primary Examiner*—José A Fortuna
(74) *Attorney, Agent, or Firm*—Gregory E. Croft

(57) ABSTRACT

A tissue sheet having a deep discontinuous pocket structure provides improved durability as measured by the ratio of the cross-machine direction tensile energy absorbed to the cross-machine direction tensile strength.

6 Claims, 14 Drawing Sheets

U.S. PATENT DOCUMENTS

| | | | | |
|---|---|---|---|---|
| 2009/0065167 | A1 * | 3/2009 | Quigley | 162/348 |
| 2009/0068909 | A1 * | 3/2009 | Quigley | 442/205 |
| 2009/0183795 | A1 * | 7/2009 | Ward et al. | 139/410 |

FOREIGN PATENT DOCUMENTS

| | | | |
|---|---|---|---|
| EP | 0 708 857 | B1 | 12/1998 |
| EP | 1770207 | A1 * | 4/2007 |
| GB | 2 279 372 | A | 1/1995 |
| WO | WO 96/24712 | A1 | 8/1996 |
| WO | WO 97/32081 | A1 | 9/1997 |
| WO | WO 00/39394 | A1 | 7/2000 |
| WO | WO 03/071031 | A1 | 8/2003 |
| WO | WO 2005/068721 | A1 | 7/2005 |
| WO | WO 2007001576 | A1 * | 1/2007 |

OTHER PUBLICATIONS

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

TAPPI Provisional Method T 570 pm-00, "Resistance to Mechanical Penetration of Sanitary Tissue Papers (Ball Burst Procedure)," published by the TAPPI Press, Atlanta, Georgia, pp. 1-7.

* cited by examiner

TISSUE PRODUCTS HAVING HIGH DURABILITY AND A DEEP DISCONTINUOUS POCKET STRUCTURE

This application is a divisional of U.S. Ser. No. 11/159,565 filed Jun. 22, 2005, now U.S. Pat. No. 7,300,543, which is a continuation-in-part of U.S. Ser. No. 10/745,184 filed Dec. 23, 2003 now abandoned. The entirety of U.S. Ser. Nos. 11/159,565 and 10/745,184 are hereby incorporated by reference.

BACKGROUND OF THE INVENTION

In the field of tissue products, such as facial tissue, bath tissue, table napkins, paper towels and the like, most product improvement efforts have been directed at the properties of softness or strength, which are inversely related. On the other hand, durability is often overlooked. Therefore there is a need for tissue products that are sufficiently soft and strong, yet durable.

SUMMARY OF THE INVENTION

It has now been discovered that tissue sheets with improved durability can be produced by using papermaking fabrics, such as transfer fabrics and/or throughdrying fabrics, that have a deep discontinuous pocket structure (herein defined). The use of such fabrics simultaneously strains the tissue sheet in the machine direction (MD) and the cross-machine direction (CD) as the sheet is molded to conform to the contour of the fabric. This conformation results in tissue sheets also having a similar corresponding deep discontinuous pocket structure of their own with improved cross-machine direction properties, particularly increased durability for a given softness level. This improved durability/softness relationship is manifested by a high cross-machine direction tensile energy absorbed (CD TEA) (hereinafter defined) per unit of cross-machine direction tensile strength (hereinafter defined). The high CD TEA/CD tensile strength ratio gives rise to products that tend to be perceived by the consumer as durable (due to the high tensile energy absorption prior to failure) and are also perceived as soft (due to the low CD tensile in the dry state prior to use). The CD properties are particularly important because tissue sheets are usually relatively weak and fail in this direction due to the orientation of the fibers primarily in the machine direction. Hence increasing the CD TEA is highly desirable in terms of providing an unusually durable tissue. While the CD TEA alone can be increased by increasing the CD tensile strength, this is not preferred as it tends to make the tissue stiffer and hence less soft in the eyes of the consumer. Therefore a proper combination of CD tensile strength and CD TEA has been determined to be highly desirable for providing consumer-preferred tissue products.

In addition to the high CD TEA/CD tensile strength ratio, tissue products produced from fabrics having a deep discontinuous pocket structure can have additional product benefits. In particular, such products can have a high CD slope (hereinafter defined) relative to products produced from non-waffle-like fabrics, which is also beneficial in producing a tissue with high durability. A high CD slope means that the beneficial CD stretch is not easily removed from the tissue when used by the consumer. Tissue products with a high CD slope will resist having the CD stretch removed when subjected to a tensile load in the CD. As a consequence, such tissues will have even greater durability. As with the TEA, the slope can be altered by tensile strength, so it can be important to maximize the CD slope while minimizing the CD tensile strength for softness purposes. Therefore, the CD slope/CD tensile strength ratio is another good measure of the durability of the tissue for a given softness level.

Finally, another property which is highly desired by tissue makers is maximum bulk or caliper. The deep pockets of the deep discontinuous pocket structure of the fabrics of this invention can provide tissue sheets with unusually high caliper (also high bulk if basis weight is kept constant). High bulk or caliper is very desirable for producing firm rolls of tissue of a fixed roll weight. In addition, by producing higher bulk tissue, the roll weight can be reduced without any reduction in roll diameter or roll firmness.

Hence, in one aspect the invention resides in a tissue sheet having a deep discontinuous pocket structure, said tissue sheet having a CD TEA/CD tensile strength ratio of about 0.070 or greater, more specifically from about 0.070 to about 0.100, more specifically from about 0.070 to about 0.090, and still more specifically from about 0.075 to about 0.085.

For purposes herein, when referring to a tissue sheet, a "deep discontinuous pocket structure" is a regular series of distinct, relatively large depressions in the surface of the tissue sheet having a z-directional depth, as measured from the surface plane of the sheet to the lowest point of the depression, of from about 1.5 to about 8 millimeters, more specifically from about 1.5 to about 5.5 millimeters, and still more specifically from about 2.0 to about 5.5 millimeters. The length or width of the depressions, as measured in the plane of the surface of the tissue sheet, can be from about 5 to about 20 millimeters, more specifically from about 10 to about 15 millimeters. Stated differently, the area of the pocket opening in the top surface plane of the fabric can be from about 25 to about 400 square millimeters, more specifically from about 100 to about 225 square millimeters. The shape of the depressions can be any shape. The frequency of occurrence of the depressions in the surface of the tissue sheet can be from about 0.8 to about 3.6 depressions per square centimeter of the tissue sheet. The upper edge of the sides of the deep discontinuous pocket structures can be relatively even or uneven, depending upon the contour of the fabric from which they were formed. Regardless of the degree of "unevenness" of the top edge or side heights of the depressions, the lowest points of the pockets are not connected to the lowest points of other pockets. The dimensions of the pockets can be determined by various means known to those skilled in the art, including simple photographs of plan views and cross-sections. Surface profilometery is particularly suitable, however, because of its precision. One such surface profilometry method of characterizing the pocket structure, useful for both the tissue sheet and the fabric, is hereinafter described.

In another aspect, the invention resides in a woven papermaking fabric having a deep discontinuous pocket structure. The fabric can be coplanar or shute dominant. For purposes herein, when referring to a fabric, a deep discontinuous pocket structure is a regular series of distinct, relatively large depressions in the surface of the fabric that are surrounded by raised warp or raised shute strands. The general shape of the pocket opening can be any shape. The pocket depth, which is the z-directional distance between the top plane of the fabric and the lowest visible fabric knuckle that the tissue web may contact, can be from about 0.5 to about 8 millimeters, more specifically from about 0.5 to about 5.5 millimeters, and still more specifically from about 1.0 to about 5.5 millimeters. Expressed differently, the pocket depth can be from about 250 to about 525 percent of the warp strand diameter. (For purposes herein, a "knuckle" is a structure formed by overlapping warp and shute strands.) The width or length of the pocket opening in the top surface plane (x-y plane) of the fabric can be from about 5 to about 20 millimeters, more specifically from about 10 to about 15 millimeters. Stated differently, the area of the pocket opening in the top surface plane of the fabric can be from about 25 to about 400 square millimeters, more specifically from about 100 to about 225 square millimeters. The frequency of occurrence of the pockets in the surface of the fabric sheet can be from about 0.8 to about 3.6 pockets per square centimeter of the fabric. The arrangement of the pockets, when viewed in the machine direction of the fabric, can be linear or offset. The height of the sides of the pockets can be even or uneven, depending upon the weave structure of the fabric. In many cases, the uppermost CD strands can be at a lower level than the uppermost MD strands and vice versa. Also, the sides can be vertical or sloped. Typically, the sides have a slope which provides better sheet support and reduces the likelihood of pinholes. As with the tissue sheet structure, regardless of the degree of "unevenness" of the top edge or side heights of the depressions, the lowest points of the pockets are not connected to the lowest points of other pockets.

In another aspect, the invention resides in a method of making a tissue sheet comprising: (a) depositing an aqueous suspension of papermaking fibers onto a forming fabric to form a wet web; (b) dewatering the web to a consistency of about 20 percent or greater; (c) optionally transferring the dewatered web to a transfer fabric having a deep discontinuous pocket structure; (d) transferring the web to a throughdrying fabric having a deep discontinuous pocket structure, whereby the web is conformed to the surface contour of the throughdrying fabric; and (e) throughdrying the web.

The CD slope/CD tensile strength ratio can be about 0.007 or greater, more specifically from about 0.007 to about 0.015, more specifically from about 0.007 to about 0.011, and still more specifically from about 0.009 to about 0.011.

The bulk of the tissue sheets of this invention can be about 60 cubic centimeters per gram (cc/g) or greater, more specifically from about 60 to about 80 cc/g, more specifically from about 65 to about 80 cc/g, and still more specifically from about 65 to about 75 cc/g.

The MD tensile strengths of the sheets of this invention can be about 800 grams or greater per 3 inches of sample width, more specifically from about 800 to about 1500 grams per 3 inches of sample width, more specifically from about 900 to about 1300 grams per 3 inches of sample width, still more specifically from about 1000 to about 1250 grams per 3 inches of sample width.

The CD tensile strengths of the sheets of this invention can be about 500 grams or greater per 3 inches of sample width, more specifically from about 500 to about 900 grams per 3 inches of sample width, and still more specifically from about 600 to about 800 grams per 3 inches of sample width.

The geometric mean tensile strength of the sheets of this invention can be about 1500 grams or less per 3 inches of width, more specifically about 1200 grams or less per 3 inches of width and still more specifically from about 500 to about 1200 grams per 3 inches of width.

The MD stretch for the sheets of this invention can be about 3 percent or greater, more specifically about 5 percent or greater, more specifically from about 3 to about 30 percent, more specifically from about 3 to about 25 percent, more specifically from about 3 to about 15 percent, and still more specifically from about 3 to about 10 percent.

The CD stretch for the sheets of this invention can be about 5 percent or greater, more specifically about 10 percent or greater, more specifically from about 5 to about 20 percent, more specifically from about 5 to about 15 percent, and still more specifically from about 5 to about 10 percent.

The geometric mean TEA can be about 20 gram-centimeters or less per square centimeter, more specifically about 10 gram-centimeters or less per square centimeter, more specifically from about 2 to about 8 gram-centimeters per square centimeter and still more specifically from about 2 to about 4 gram-centimeters per square centimeter.

The basis weight of the tissue sheets of this invention can be from about 10 to about 45 grams per square meter (gsm), more specifically from about 10 to about 35 gsm, still more specifically from about 20 to about 35 gsm, more specifically from about 20 to about 30 gsm and still more specifically from about 25 to about 30 gsm.

The tissue sheets of this invention can be layered or nonlayered (blended). Layered sheets can have two, three or more layers. For tissue sheets that will be converted into a single-ply product, it can be advantageous to have three layers with the outer layers containing primarily hardwood fibers and the inner layer containing primarily softwood fibers. Tissue sheets in accordance with this invention would be suitable for all forms of tissue products including, but not limited to, bathroom tissue, kitchen towels, facial tissue and table napkins for consumer and services markets.

Furthermore, to be commercially advantaged, it is desirable to minimize the presence of pinholes in the sheet. The degree to which pinholes are present can be quantified by the Pinhole Coverage Index, the Pinhole Count Index and the Pinhole Size Index, all of which are determined by an optical test method known in the art and described in U.S. Pat. No. 6,673,202 B2 entitled "Wide Wale Tissue Sheets and Method of Making Same", granted Jan. 6, 2004, which is herein incorporated by reference. More particularly, the "Pinhole Coverage Index" is the arithmetic mean percent area of the sample surface area, viewed from above, which is covered or occupied by pinholes. For purposes of this invention, the Pinhole Coverage Index can be about 0.25 or less, more specifically about 0.20 or less, more specifically about 0.15 or less, and still more specifically from about 0.05 to about 0.15. The "Pinhole Count Index" is the number of pinholes per 100 square centimeters that have an equivalent circular diameter (ECD) greater than 400 microns. For purposes of this invention, the Pinhole Count Index can be about 65 or less, more specifically about 60 or less, more specifically about 50 or less, more specifically about 40 or less, still more specifically from about 5 to about 50, and still more specifically from about 5 to about 40. The "Pinhole Size Index" is the mean equivalent circular diameter (ECD) for all pinholes having an ECD greater than 400 microns. For purposes of this invention, the Pinhole Size Index can be about 600 or less, more specifically about 500 or less, more specifically from about 400 to about 600, still more specifically from about 450 to about 550. By way of example, current commercially available Charmin® bathroom tissue has a Pinhole Coverage Index of from 0.01-0.04, a Pinhole Count Index of from 250-1000, and a Pinhole Size Index of 550-650.

Suitable papermaking processes useful for making tissue sheets in accordance with this invention include uncreped throughdrying processes which are well known in the tissue and towel papermaking art. Such processes are described in U.S. Pat. No. 5,607,551 issued Mar. 4, 1997 to Farrington et al., U.S. Pat. No. 5,672,248 issued Sep. 30, 1997 to Wendt et al. and U.S. Pat. No. 5,593,545 issued Jan. 14, 1997 to Rugowski et al., all of which are hereby incorporated by reference. Throughdrying processes with creping, however, can also be used.

Fabric terminology used herein follows naming conventions familiar to those skilled in the art. For example, warps are typically machine-direction yarns and shutes are cross-machine direction yarns, although it is known that fabrics can be manufactured in one orientation and run on a paper machine in a different orientation. As used herein, "warp dominant" fabrics are characterized by a top plane dominated by warp floats, or MD impression knuckles, passing over 2 or more shutes. There are no cross-machine direction knuckles in the top plane. Examples of warp dominant fabrics can be found in U.S. Pat. No. 5,746,887, to Wendt et al. and U.S. Pat. No. 5,429,686 to Chiu et al. Simple dryer or conveying fabrics containing only 1 or 2 unique warp paths per unit cell of the weave pattern and in which all portion of all warp floats rise to the same top plane are considered to be "warp co-planar" and are excluded from the present analysis. Examples of commercially available warp co-planar dryer fabrics are the Voith "Onyx" and Voith "Monotex II Plus" designs.

As used herein, "shute dominant" fabrics are characterized by a top plane dominated by shute floats, or CD impression knuckles, passing over 2 or more warps. There are no machine direction knuckles in the top plane. "Coplanar" fabrics are characterized by a top plane containing both warp floats and shute floats which are substantially co-planar. For the purposes of this invention, co-planar fabrics are characterized by knuckle heights (hereinafter defined) above the intermediate plane (hereinafter defined) less than 8% of the combined sum of average warp and shute diameters. Alternatively, co-planar fabrics can be characterized as having bearing areas (hereinafter defined) which are less than 5% at the intermediate plane. The fabrics of this invention can be warp dominant, shute dominant, or coplanar. Persons skilled in the art are aware that changing weaving parameters such as weave pattern, mesh, count, or yarn size as well as heat setting conditions can affect which yarns form the highest plane in the fabric.

As used herein, "intermediate plane" is defined as the plane formed by the highest points of the perpendicular yarn knuckles. For warp dominant fabrics, the intermediate plane is defined as the plane formed by the highest points of the shute knuckles, as in Wendt et al. For shute dominant fabrics, the intermediate plane is defined as the plane formed by the highest points of the warp knuckles. There is no intermediate plane for co-planar structures.

As used herein, the "pocket bottom" is defined by the top of the lowest visible yarn which a tissue web can contact when molding into the textured, fabric. Only yarn elements which are at least as width as they are long were considered when visually defining the z-direction plane intersecting the pocket bottom with profilometry software. The pocket bottom can be defined by a warp knuckle, a shute knuckle, or by both. The "pocket bottom plane" is the z-direction plane intersecting the top of the elements comprising the pocket bottom.

As used herein, the fabric "knuckle height" is defined as the distance from the top plane of the fabric to another specified z-direction plane in the fabric, such as the intermediate plane or the pocket bottom. The fabrics of this invention are characterized by deep, discontinuous pocket structures in which "deep" means of a z-direction height greater than one warp yarn diameter and in which "discontinuous" denotes that the bottoms of individual pockets are separated from adjacent pockets by the pocket wall structure comprised of raised warps or raised shutes. Note that the pocket walls can have any shape and the top of the pockets do not have to be bound by both warp and shute floats. For the purposes of this invention, the "pocket height" is defined as the distance from the top plane of the fabric to the pocket bottom.

As used herein, "bearing area" or material ratio DTp, is the amount of area occupied by the fabric material at a depth p below the highest feature of the surface, expressed as a percentage of the assessment area. In this work, bearing areas have been determined from Abbott-Firestone curves, or material ratio curves, via standard metrology software and are reported at each referenced z-direction location.

In the interests of brevity and conciseness, any ranges of values set forth in this specification contemplate all values within the range and are to be construed as support for claims reciting any sub-ranges having endpoints which are whole number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

Test Procedures

Tensile strengths and related parameters are measured using a crosshead speed of 254 millimeters per minute, a full scale load of 4540 grams, a jaw span (gauge length) of 50.8 millimeters and a specimen width of 762 millimeters. The MD tensile strength is the peak load per 3 inches of sample width when a sample is pulled to rupture in the machine direction. Similarly, the CD tensile strength represents the peak load per 3 inches of sample width when a sample is pulled to rupture in the cross-machine direction. For purposes herein, tensile strengths are reported as grams per centimeter of sample width. For 1-ply products each tensile strength measurement is done on 1-ply. For multiple ply products tensile testing is done on the number of plies expected in the finished product. For example, 2-ply products are tested two plies at one time and the recorded MD and CD tensile strengths are the strengths of both plies. The same testing procedure is used for samples intended to be more than two plies.

More particularly, samples for tensile strength testing are prepared by cutting a 3 inches (76.2 mm) wide×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10 and 90% of the load cell's full scale value. The gauge length between jaws is 2+/−0.04 inches (50.8+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is", and the arithmetic average of all individual specimen tests is either the MD or CD tensile strength for the product.

In addition to tensile strength, the stretch, tensile energy absorbed (TEA), and slope are also reported by the MTS TestWorks® for Windows Ver. 3.10 program for each sample measured. Stretch (either MD stretch or CD stretch) is reported as a percentage and is defined as the ratio of the slack-corrected elongation of a specimen at the point it generates its peak load divided by the slack-corrected gauge length. Slope is reported in the units of grams (g) and is defined as the gradient of the least-squares line fitted to the load-corrected strain points falling between a specimen-generated force of 70 to 157 grams (0.687 to 1.540 N) divided by the specimen width.

Total energy absorbed (TEA) is calculated as the area under the stress-strain curve during the same tensile test as has previously described above. The area is based on the strain value reached when the sheet is strained to rupture and the load placed on the sheet has dropped to 65 percent of the peak tensile load. Since the thickness of a paper sheet is generally unknown and varies during the test, it is common practice to ignore the cross-sectional area of the sheet and report the "stress" on the sheet as a load per unit length or typically in the units of grams per 3 inches of width. For the TEA calculation, the stress is converted to grams per centimeter and the area calculated by integration. The units of strain are centimeters per centimeter so that the final TEA units become g-cm/cm$^2$.

As used herein, the sheet "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the sheet "bulk" is calculated as the quotient of the "caliper", expressed in microns, divided by the dry basis weight, expressed in grams per square meter. The resulting sheet bulk is expressed in cubic centimeters per gram.

For purposes herein, optical surface profilometry can be used to map the three-dimensional topography of the tissue sheets or the fabrics. The three-dimensional optical surface topography maps can be determined using a MicroProf™ measuring system equipped with a CHR 150 N optical distance measurement sensor with 10 nm resolution (system available from Fries Research and Technology GmbH, Gladbach, Germany). The MicroProf measures z-direction distances by utilizing chromatic aberration of optical lenses to analyze focused white light reflected from the sample surface. An x-y table is used to move the sample in the machine direction (MD) and cross-machine direction (CD). MD and CD resolution for most samples can be set at 20 um to ensure at least 10 data points are collected across each yarn diameter, with the finer fabric samples scanned at 10 um x-y resolution.

The three-dimensional surface profilometry maps can be exported from MicroProf in a unified data file format for analysis with surface topography software TalyMap Universal (ver 3.1.10, available from Taylor-Hobson Precision Ltd., Leicester, England). The software utilizes the Mountains® technology metrology software platform (www.digitalsurf.fr) to allow a user to import various profiles and then execute different operators (mathematical transformations) or studies (graphical representations or numeric calculations) on the profiles and present them in a format suitable for desktop publishing.

The resultant Mountain® documents containing the various post-operation profiles and studies can then be printed to a screen-capture software (Snag-It from TechSmith, Okemos, Mich.) and exported into a Microsoft Word document for file sharing.

Within the TalyMap software, operators utilized for different 3-D profiles includes thresholding, which is an artificial truncation of the profile at a given altitudes. Specification of the altitude thresholds, or altitudes of horizontal planes intersecting the profile, are derived by visual observation of the fabric material remaining or excluded in the interactive thresholded profile and its corresponding depth histogram showing the statistical depth distribution of the points on the profile. The first thresholding cleans up the image and adjusts the ranges of the depths recorded, yielding the "surface profilometry results" profile which focuses only on the fabric and not any surface dust or tape holding the fabric sample in place. The second thresholding effectively defines the location of the top surface plane of the fabric (highest surface points); the intermediate plane (highest point of the highest shute (CD yarn) knuckles in the load-bearing layer); and the pocket bottom.

DETAILED DESCRIPTION OF THE DRAWINGS

Figure 1:
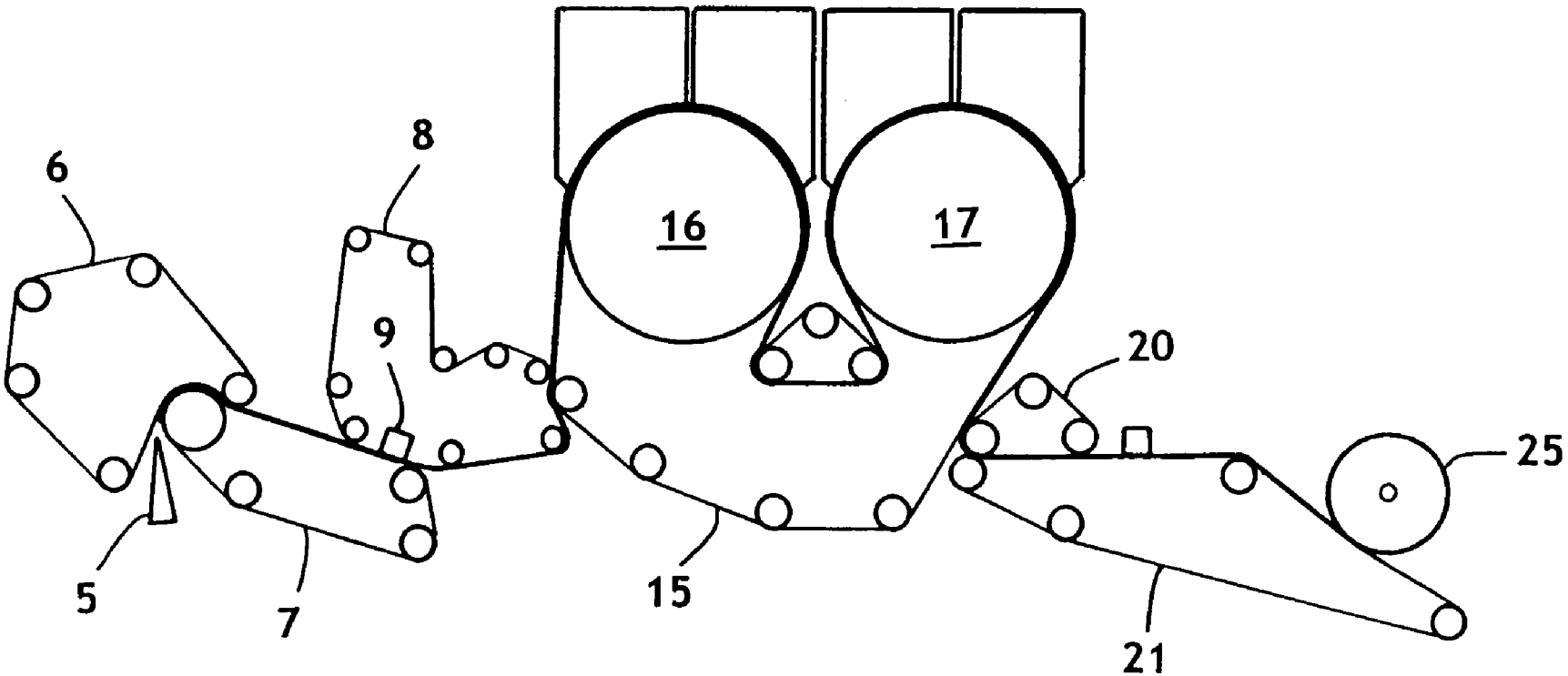
FIG. 1 is a schematic flow diagram of a tissue making process useful for making tissues in accordance with this invention.

Referring to FIG. 1, shown is an uncreped throughdried tissue making process in which a multi-layered headbox 5 deposits an aqueous suspension of papermaking fibers between forming wires 6 and 7. The newly-formed web is transferred to a slower moving transfer fabric 8 with the aid of at least one vacuum box 9. The level of vacuum used for the web transfers can be from about 3 to about 15 inches of mercury (76 to about 381 millimeters of mercury), preferably about 10 inches (254 millimeters) of mercury. The vacuum box (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum box(es).

The web is then transferred to a throughdrying fabric 15 and passed over throughdryers 16 and 17 to dry the web. The side of the web contacting the throughdrying fabric is referred to herein as the "fabric side" of the web. The opposite side of the web is referred to as the "air side" of the web. While supported by the throughdrying fabric, the web is final dried to a consistency of about 94 percent or greater. After drying, the sheet is transferred from the throughdrying fabric to fabric 20 and thereafter briefly sandwiched between fabrics 20 and 21. The dried sheet remains with fabric 21 until it is wound up at the reel 25. Thereafter, the tissue sheet can be unwound, calendered and converted into the final tissue product, such as a roll of bath tissue, in any suitable manner.

Figure 2:
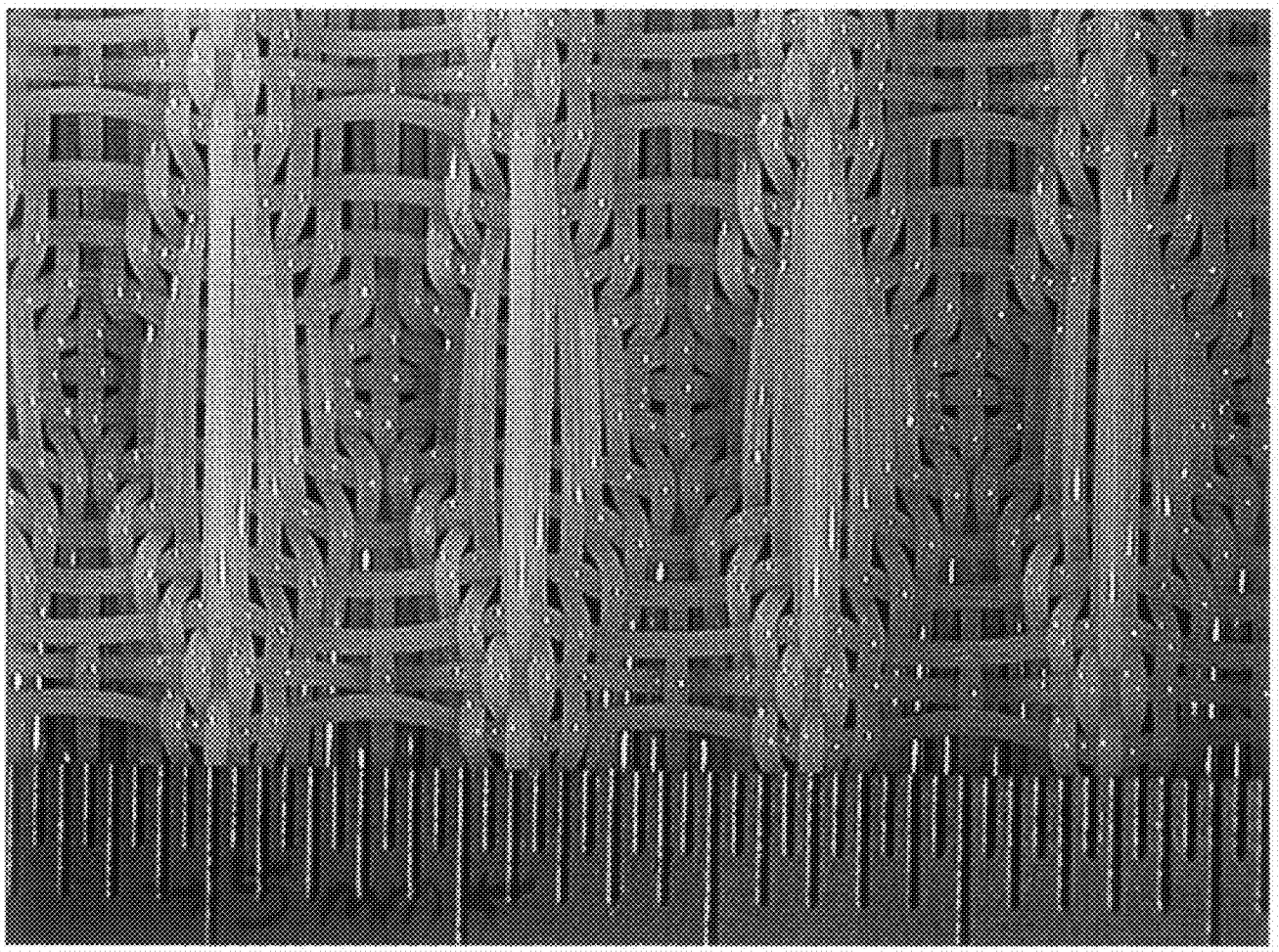
FIGS. 2-14 are plan view photographs of different fabrics in accordance with this invention.

FIGS. 2-14 are plan view photographs of various fabrics in accordance with this invention, illustrating the weave patterns used to produce the deep discontinuous pocket structure and the various shapes of the pockets. More specifically, FIG. 2 is a plan view photograph of a papermaking fabric in accordance with this invention, referenced as style KC-11. For this photograph and those that follow, lighting was provided from the top and side, so that the depressed areas in the fabric are dark and the raised areas are light. For photos including a ruler, the space between each of the vertical lines in the scale at the bottom of the photograph represents one millimeter. FIG. 2 shows the machine contacting side of the fabric.

Figure 3:
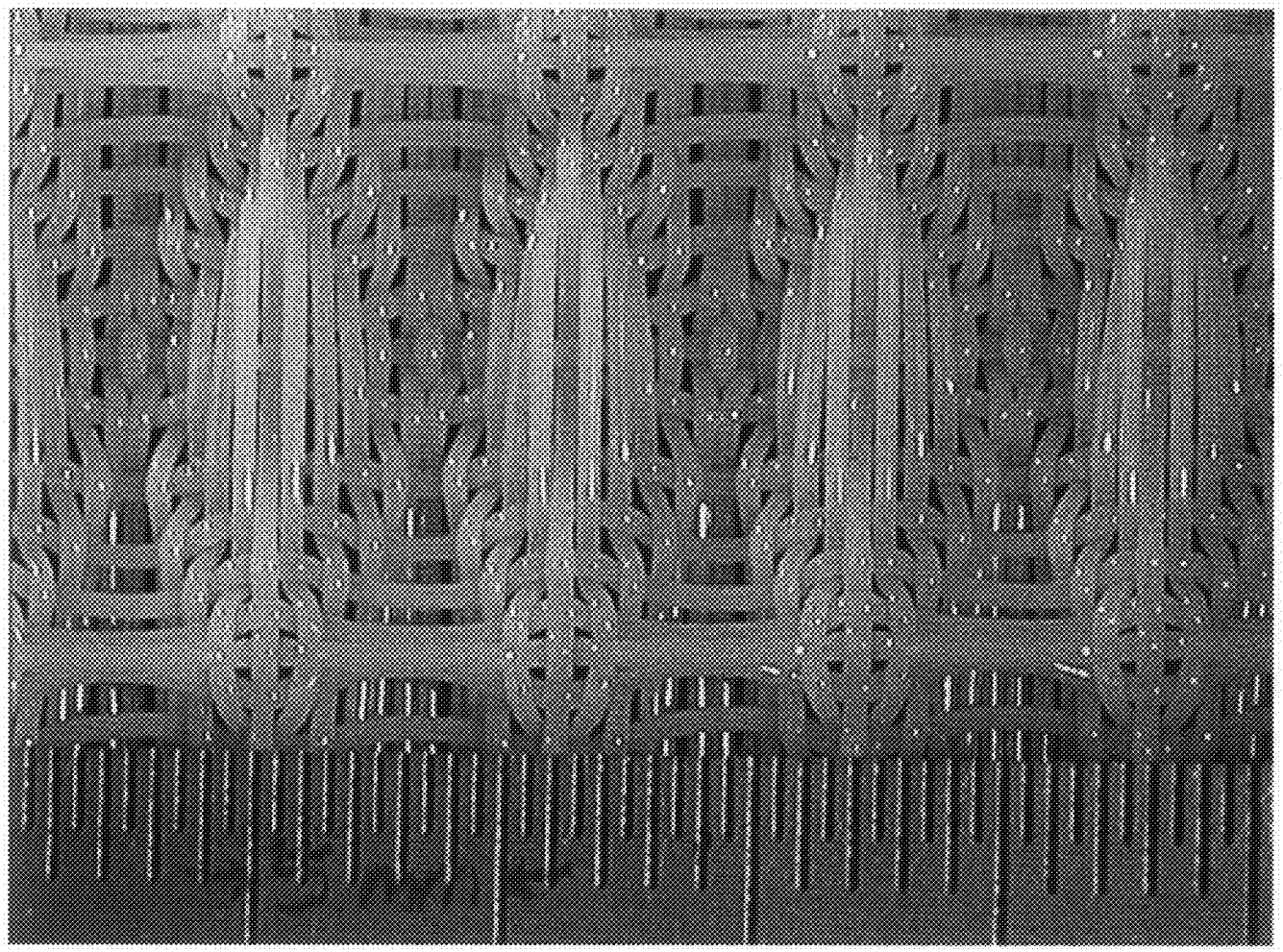

FIG. 3 is a plan view photograph of the tissue contacting side of inventive fabric KC-11, illustrating the weave pattern used to produce the deep discontinuous pocket structure and the shape of the pocket.

Figure 4:
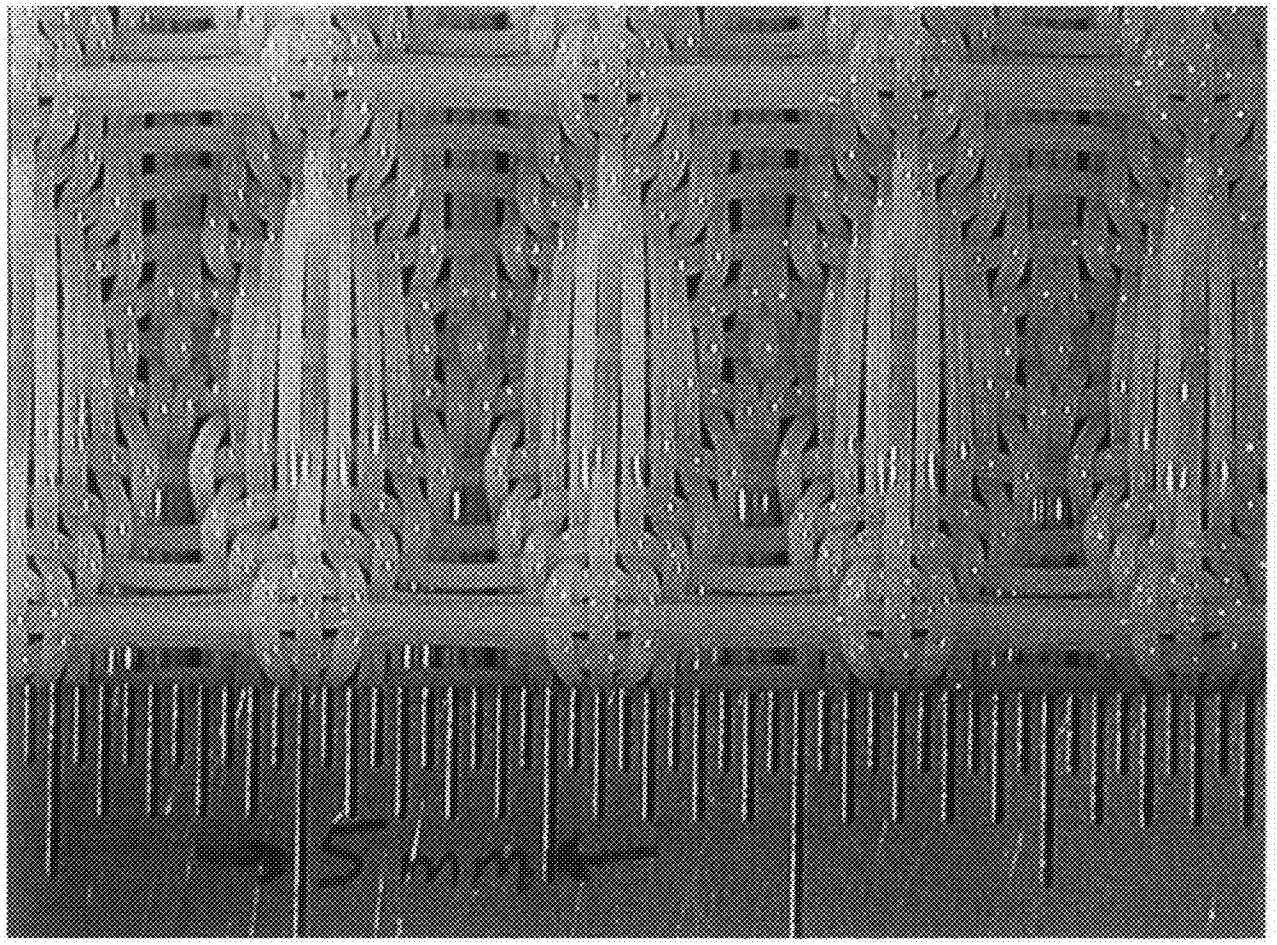

FIG. 4 is a plan view photograph of the tissue contacting side of inventive fabric KC-12.

Figure 5:
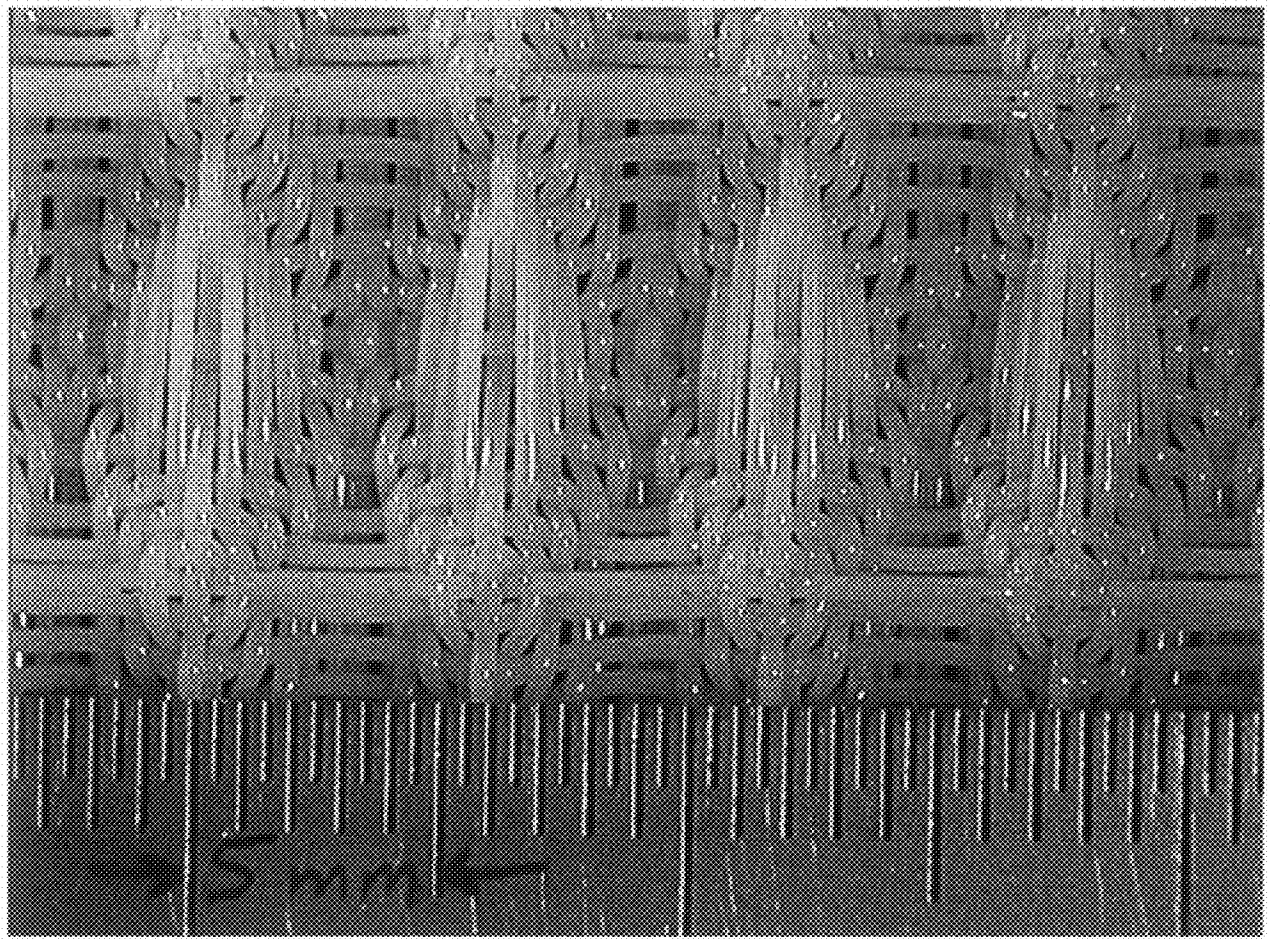

FIG. 5 is a plan view photograph of the tissue contacting side of inventive fabric KC-13.

Figure 6:
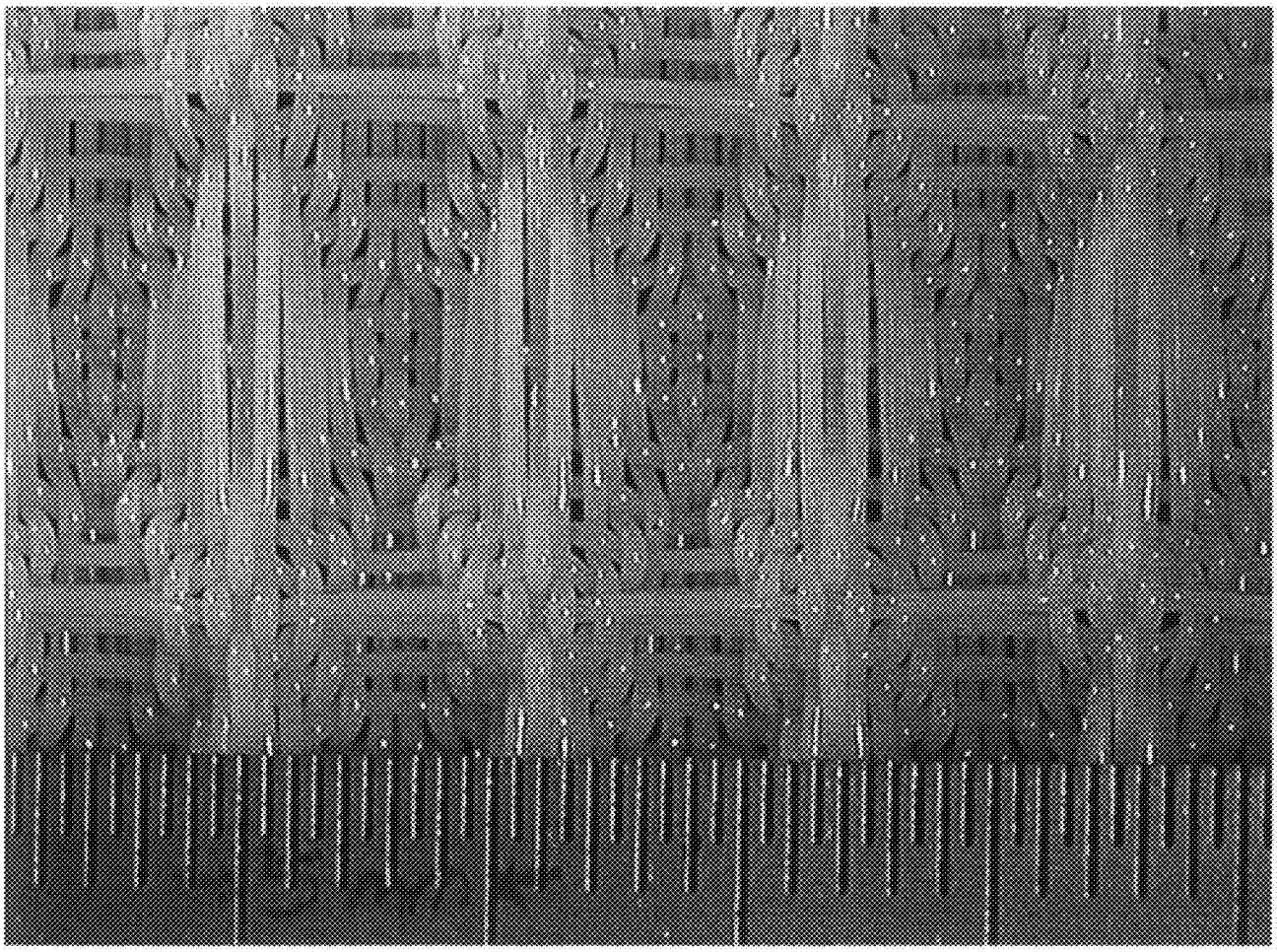

FIG. 6 is a plan view photograph of the machine contacting side of inventive fabric KC-14.

Figure 7:
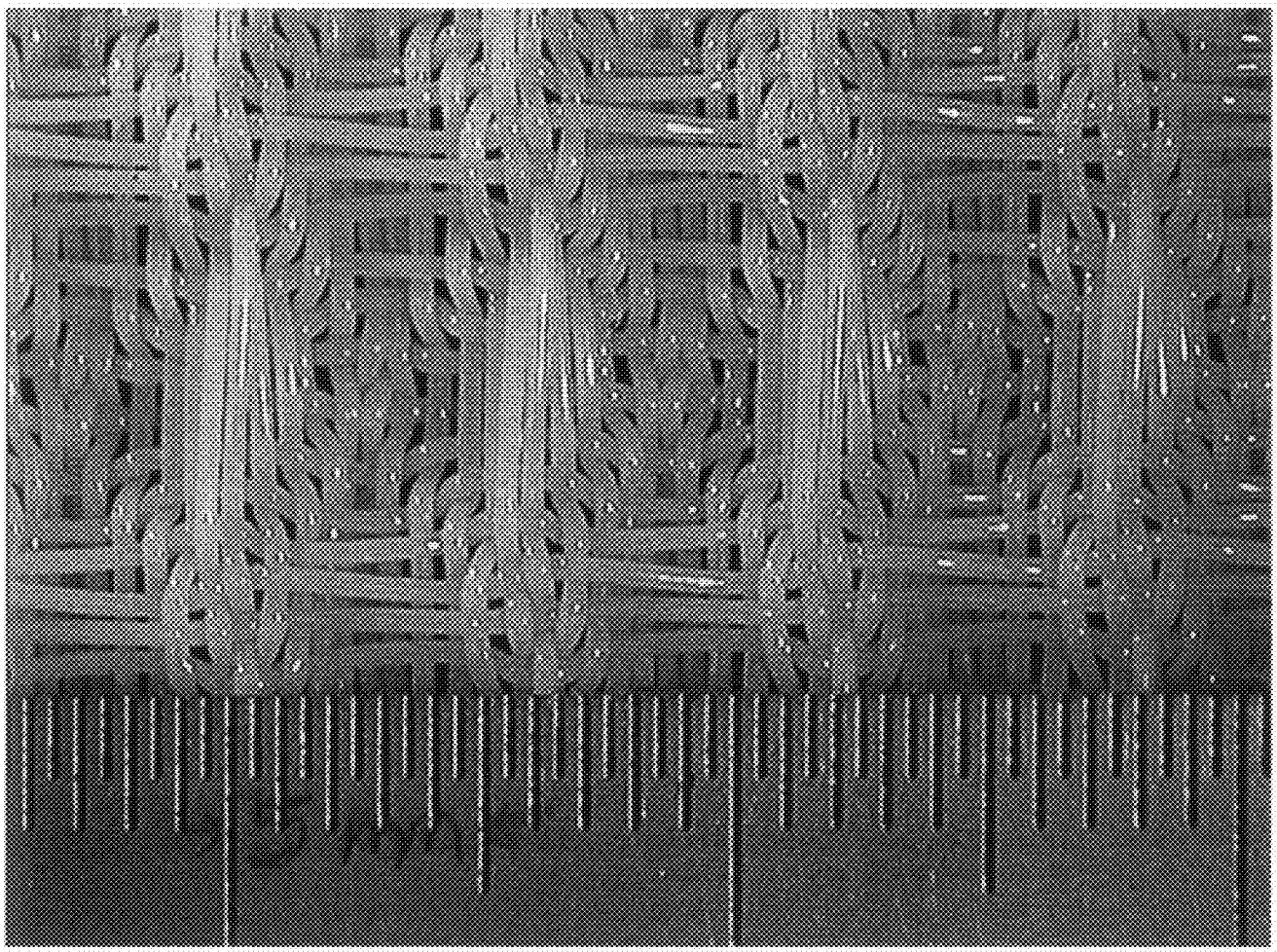

FIG. 7 is a plan view photograph of the tissue contacting side of inventive fabric KC-15.

Figure 8:
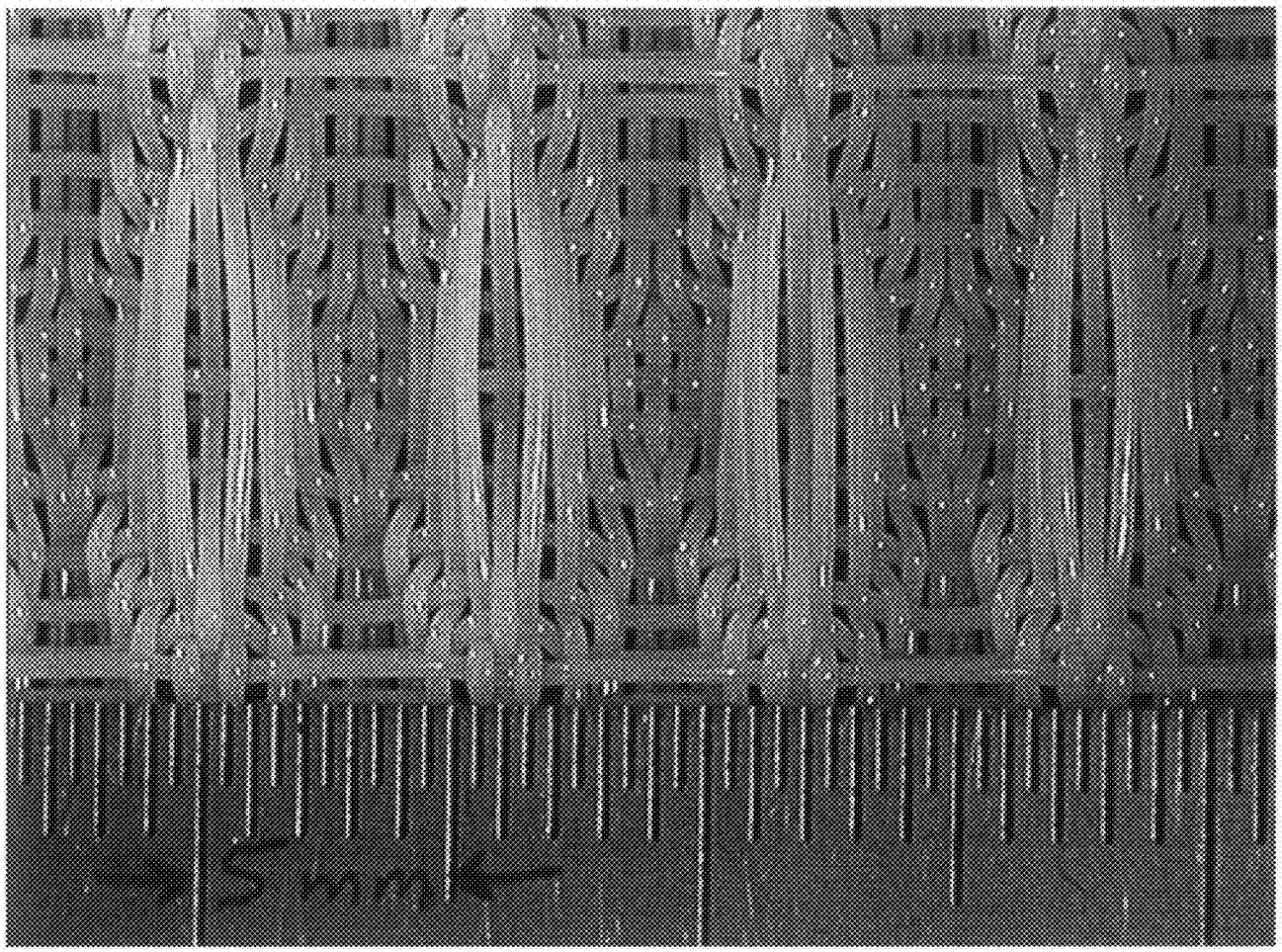

FIG. 8 is a plan view photograph of the machine contacting side of inventive fabric KC-16.

Figure 9:
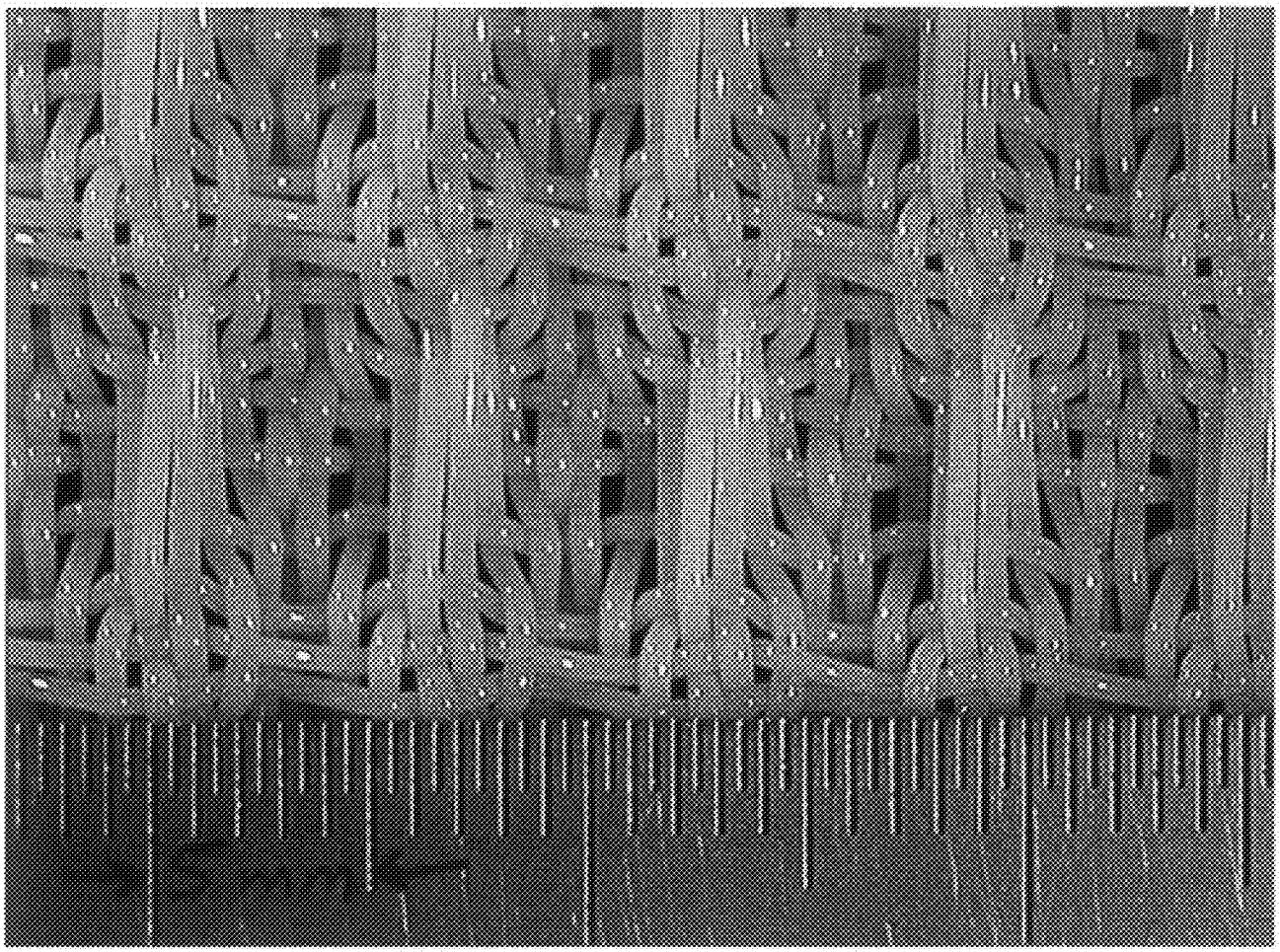

FIG. 9 is a plan view photograph of the tissue contacting side of inventive fabric KC-17.

Figure 10:
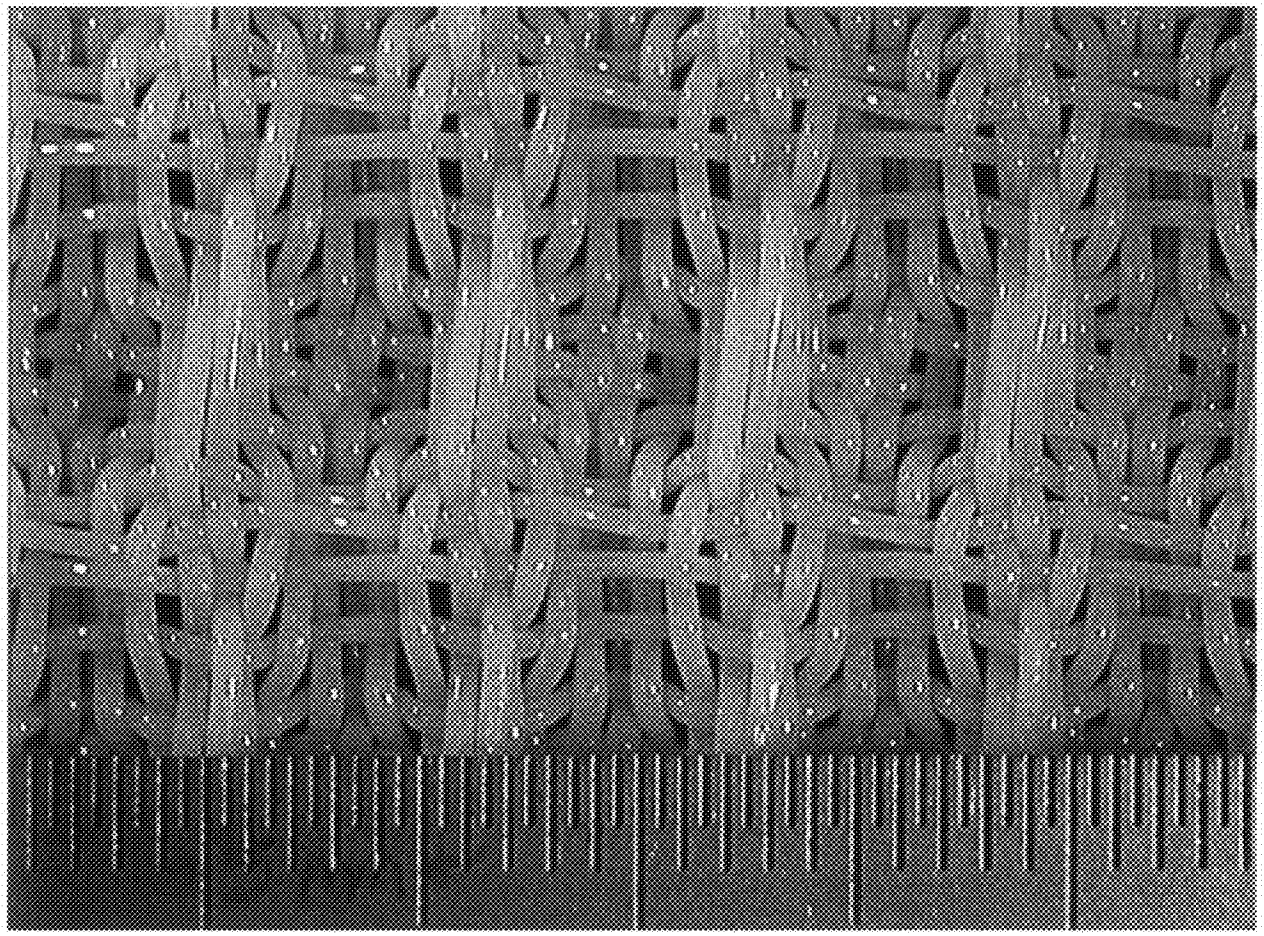

FIG. 10 is a plan view photograph of the machine contacting side of inventive fabric KC-18.

Figure 11:
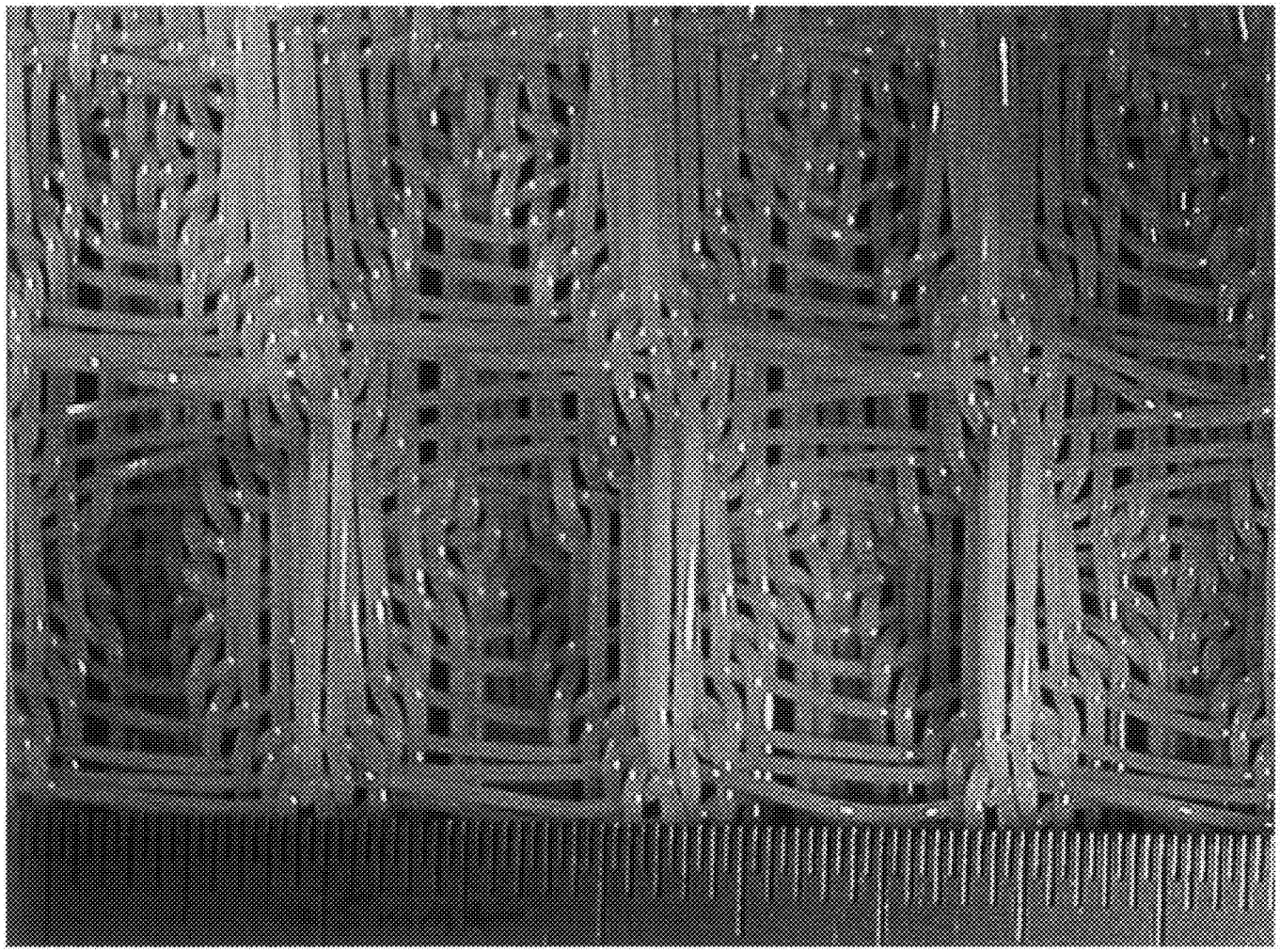

FIG. 11 is a plan view photograph of the tissue contacting side of inventive fabric KC-19.

Figure 12:
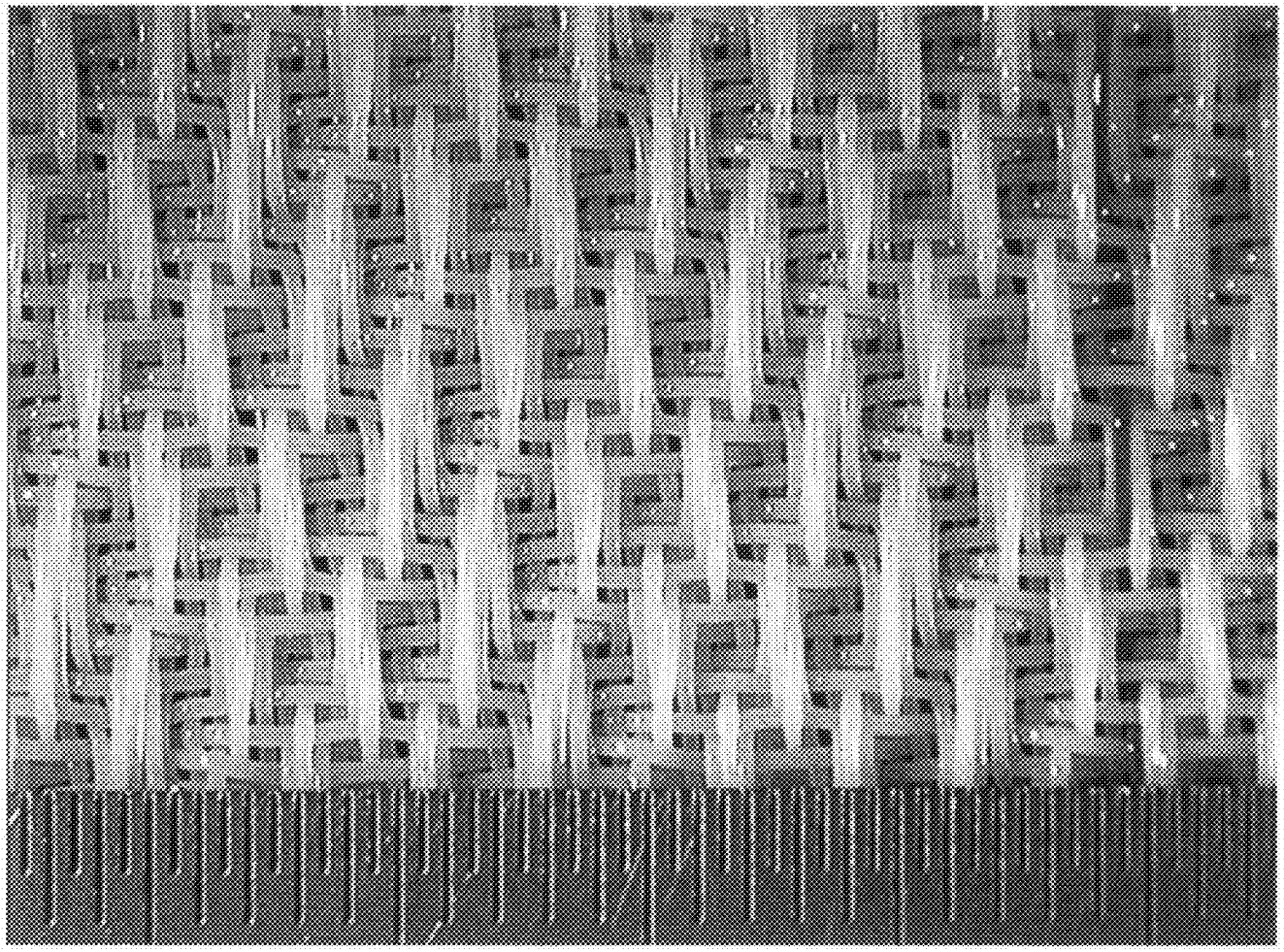

FIG. 12 is a plan view photograph of the tissue contacting side of inventive fabric KC-21, illustrating non-uniform wall heights surrounding the pocket structure.

Figure 13:
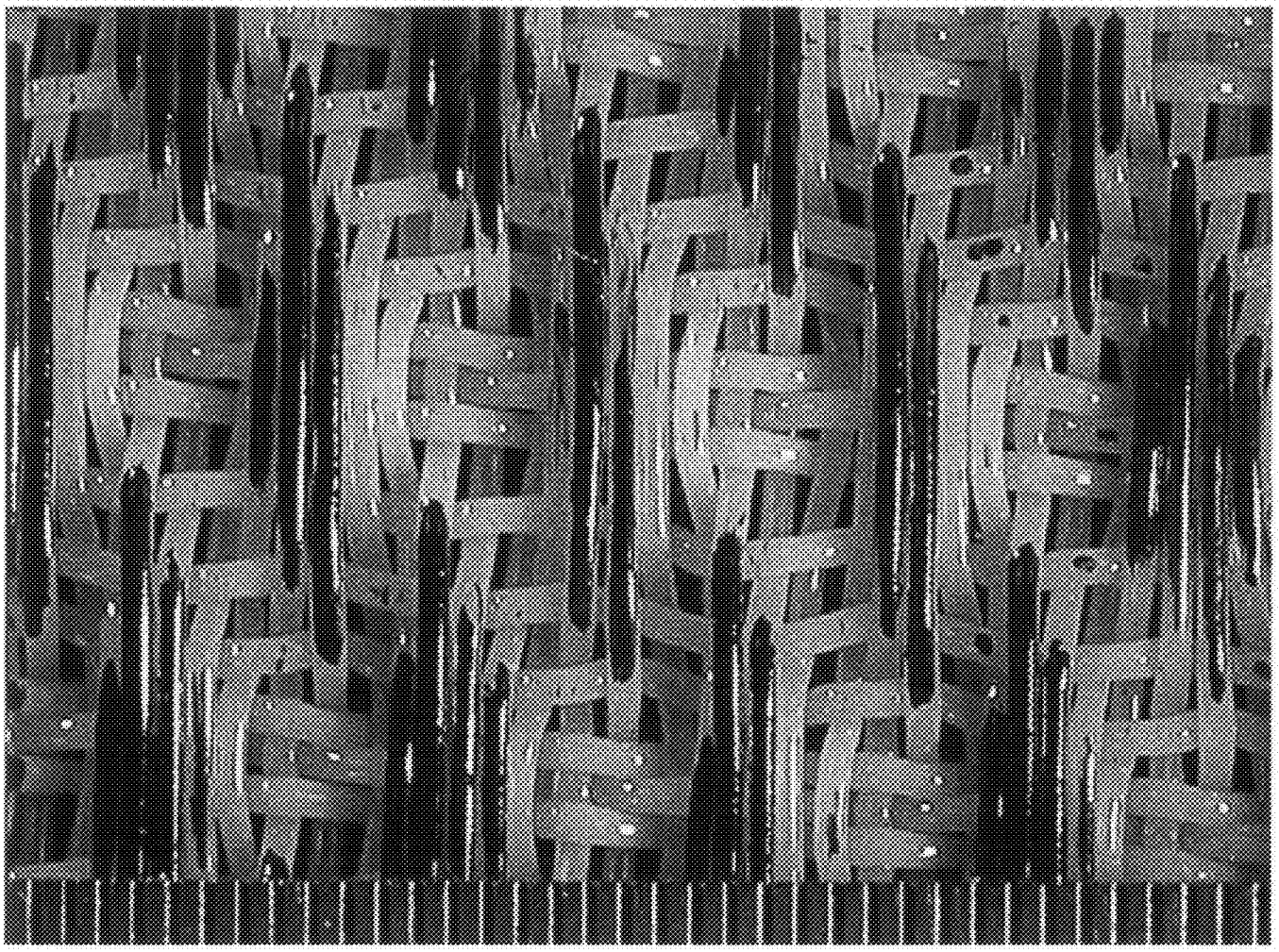

FIG. 13 is a photograph of the Voith Fabrics t124-1 papermaking fabric as disclosed in U.S. Pat. No. 5,746,887 to Wendt et al.

Figure 14:
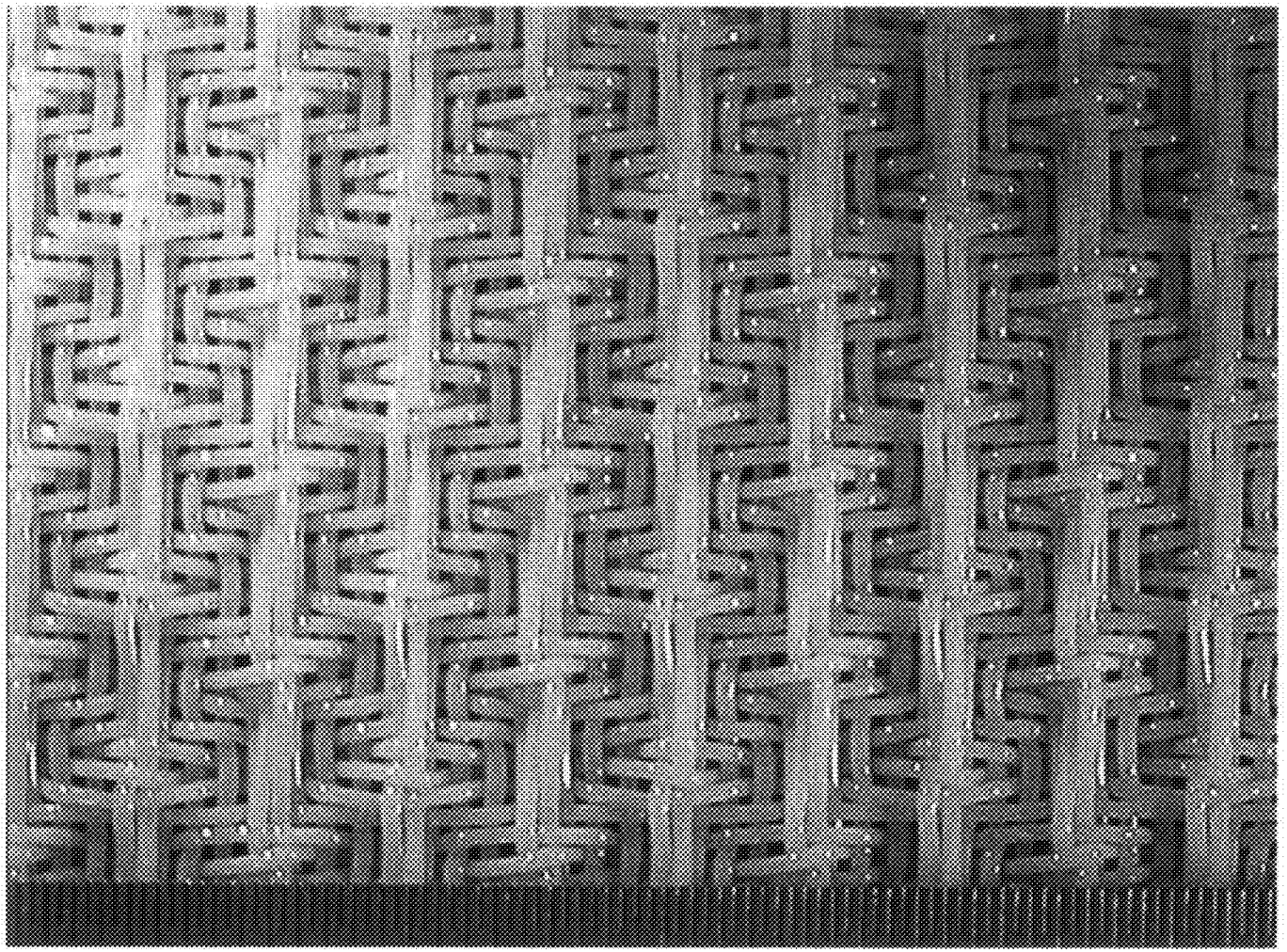

FIG. 14 is a photograph of the Voith Fabrics t1203-6 papermaking fabric as disclosed in U.S. Pat. No. 6,673,202 B2 to Burazin et al.

EXAMPLES

Example 1

A pilot uncreped throughdried tissue machine was configured similarly to that disclosed in U.S. Pat. No. 5,607,551 to Farrington et al. and was used to produce a one-ply, uncreped throughdried bath tissue basesheet. In particular, a fiber furnish comprising 35% LL-19 and 65% Eucalyptus fiber was fed to a Fourdrinier former using a Voith Fabrics 2164-B33 forming fabric (commercially available from Voith Fabrics in Raleigh, N.C.). A flow spreader headbox was utilized to deliver a blended sheet. The speed of the forming fabric was about 0.35 meters per second. The newly-formed wet tissue web was then dewatered to a consistency of about 30 percent using vacuum suction before being transferred to a transfer fabric which was traveling at about 0.27 meters per second (about 30% rush transfer). The transfer fabric was a Voith Fabrics 2164-B33 fabric. A vacuum shoe pulling about 23 centimeters of mercury vacuum was used to transfer the wet tissue web to the transfer fabric.

The wet tissue web was then transferred to a Voith Fabrics 2164-B33 throughdrying fabric. The throughdrying fabric was traveling at a speed of about 0.27 meters per second (0% rush transfer). A vacuum shoe pulling about 13 centimeters of mercury vacuum was used to transfer the wet tissue web to the throughdrying fabric. The wet tissue web was carried over a throughdryer operating at a temperature of about 118° C. and dried to a final dryness of at least 95 percent consistency.

Bath tissue basesheet was produced with an oven-dry basis weight of approximately 29 gsm. The resulting product was equilibrated for at least 4 hours in TAPPI Standard conditions (73° F., 50% relative humidity) before tensile testing. All testing was performed on basesheet from the pilot machine without further processing. The process conditions are shown in Table 1. The resulting product tensile properties are reported in Table 2. Geometric mean tensile data is calculated as the square root of (MD times CD properties). Because the 2164 fabrics have very low topography, the resultant tissue had very little molding and hence low CD stretch and caliper.

Example 2

Tissue sheets were made as in Example 1 with the following exceptions. The transfer fabric was a Voith Fabrics 2164-B33 fabric and was traveling at 0.35 m/sec (0% rush transfer). The wet tissue web was then transferred to a Voith Fabrics t1207-6 throughdrying fabric. The throughdrying fabric was traveling at a speed of about 0.27 meters per second (30% rush transfer).

Bath tissue basesheet was produced with an oven-dry basis weight of approximately 31 gsm. The resulting product was equilibrated for at least 4 hours in TAPPI Standard conditions (73° F., 50% relative humidity) before tensile testing. All testing was performed on basesheet from the pilot machine without further processing. The process conditions are shown in Table 1. The resulting product tensile properties are reported in Table 2.

Examples 3-13

To illustrate the fabrics of this invention, a woven throughdrying fabric was manufactured which contained 10 different deep pocket-structure fabric designs progressing in a machine-direction sequence along with a t1207-6 control. Tissue sheets were made as in Example 1 with the following exceptions. The transfer fabric was a Voith Fabrics t1207-6 fabric and was traveling at 0.27 m/sec (30% rush transfer). The wet tissue web was then transferred to the sampler belt throughdrying fabric. The throughdrying fabric was traveling at a speed of about 0.27 meters per second (0% rush transfer).

During manufacturing, the first and second transfer vacuum settings were adjusted to a constant valve position ensure acceptable pinhole levels for all manufactured codes, e.g. across all different fabric types, since the woven fabric designs varied widely in texture. A vacuum shoe pulling an average of 34 centimeters of mercury vacuum was used to transfer the wet tissue web to the transfer fabric. A vacuum shoe pulling an average of 27 centimeters of mercury vacuum was used to transfer the wet tissue web to the throughdrying fabric: actual vacuum levels for each fabric style are reported in Table 2.

Bath tissue basesheet was produced with an oven-dry basis weight of approximately 29 gsm. The resulting product was equilibrated for at least 4 hours in TAPPI Standard conditions (73° F., 50% relative humidity) before tensile testing. All testing was performed on basesheet from the pilot machine without further processing. The process conditions are shown in Table 1. The resulting product tensile properties are reported in Table 2. Because the t1207-6 transfer fabric can provide exceptional tissue CD properties on its own, the net benefit seen by the different inventive fabrics is smaller than if a flat transfer fabric like a Voith Fabrics 2164-B33 had been used.

Tables 3 and 4 provide details of the various fabric constructions, including fabrics illustrated in FIGS. 2-14 as well as the fabrics used in the Examples.

TABLE 1

| Example | Fabric Transfer | Fabric TAD | Headbox H2O gpm | Vacuum HB Bot cm Hg | Vacuum HB Top cm H2O | Vacuum Dewater cm H2O | Vacuum Transfer 1 cm Hg | Vacuum Transfer 2 cm Hg | Transfer Speed m/sec | TAD Speed m/sec | Rush Transfer | Ambient Basis Weight gsm |
|---|---|---|---|---|---|---|---|---|---|---|---|---|
| 1 (Control) | 2164-B33 | 2164-B33 | 45 | 59.7 | 61.0 | 13.5 | 22.9 | 24.1 | 0.27 | 0.27 | 30% (#1) | 29.47 |
| 2 (Control) | 2164-B33 | t1207-6 | 45 | 67.3 | 66.0 | 14.0 | 23.6 | 21.6 | 0.35 | 0.27 | 30% (#2) | 30.94 |
| 3 (Control) | t1207-6 | t1207-6 | 45 | 59.7 | 57.2 | 32.3 | 34.3 | 26.7 | 0.27 | 0.27 | 30% (#1) | 32.50 |
| 4 | t1207-6 | KC-1 | 45 | 59.7 | 57.2 | 32.3 | 34.3 | 25.4 | 0.27 | 0.27 | 30% (#1) | 29.24 |
| 5 | t1207-6 | KC-2 | 45 | 59.7 | 57.2 | 32.3 | 34.3 | 25.4 | 0.27 | 0.27 | 30% (#1) | 28.96 |
| 6 | t1207-6 | KC-3 | 45 | 59.7 | 57.2 | 32.3 | 34.3 | 27.2 | 0.27 | 0.27 | 30% (#1) | 28.97 |
| 7 | t1207-6 | KC-4 | 45 | 59.7 | 57.2 | 32.3 | 34.3 | 26.7 | 0.27 | 0.27 | 30% (#1) | 28.98 |
| 8 | t1207-6 | KC-5 | 45 | 59.7 | 57.2 | 32.3 | 34.3 | 25.4 | 0.27 | 0.27 | 30% (#1) | 29.85 |
| 9 | t1207-6 | KC-6 | 45 | 59.7 | 57.2 | 32.3 | 34.3 | 25.4 | 0.27 | 0.27 | 30% (#1) | 28.29 |
| 10 | t1207-6 | KC-7 | 45 | 59.7 | 57.2 | 32.3 | 34.3 | 25.4 | 0.27 | 0.27 | 30% (#1) | 28.52 |
| 11 | t1207-6 | KC-8 | 45 | 59.7 | 57.2 | 32.3 | 34.3 | 25.4 | 0.27 | 0.27 | 30% (#1) | 28.43 |
| 12 | t1207-6 | KC-9 | 45 | 59.7 | 57.2 | 32.3 | 34.3 | 24.1 | 0.27 | 0.27 | 30% (#1) | 28.92 |
| 13 | t1207-6 | KC-10 | 45 | 59.7 | 57.2 | 32.3 | 34.3 | 27.9 | 0.27 | 0.27 | 30% (#1) | 28.75 |

TABLE 2

| Example | Caliper mm | MD Tensile g/cm | MD Stretch % | MD Slope g/cm | MD TEA g · cm/cm$^2$ | CD Tensile g/cm | CD Stretch % | CD Slope g/cm | CD TEA g · cm/cm$^2$ | CDTEA/CD Tensile Ratio | GMT g/3" | Bulk cc/g | CD Slope/CD Tensile Ratio |
|---|---|---|---|---|---|---|---|---|---|---|---|---|---|
| 1 (Control) | 0.285 | 96.3 | 10.08 | 2.66 | 7.67 | 115 | 1.79 | 5.90 | 1.67 | 0.015 | 802 | 8.3 | .051 |
| 2 (Control) | 0.638 | 119.6 | 17.15 | 0.75 | 10.48 | 90 | 8.77 | 1.04 | 4.73 | 0.053 | 792 | 20.6 | .012 |
| 3 (Control) | 0.724 | 137.9 | 19.43 | 0.74 | 14.65 | 107 | 12.46 | 0.52 | 7.03 | 0.066 | 925 | 22.3 | .0049 |
| 4 | 0.860 | 131.9 | 17.92 | 0.77 | 13.2 | 71 | 11.18 | 0.71 | 6.24 | 0.088 | 739 | 29.4 | .010 |
| 5 | 0.774 | 149.5 | 15.20 | 0.89 | 12.54 | 83 | 10.05 | 0.84 | 6.15 | 0.074 | 847 | 26.7 | .010 |
| 6 | 0.810 | 148.2 | 17.33 | 0.85 | 13.86 | 74 | 10.46 | 0.77 | 5.75 | 0.078 | 797 | 28.0 | .010 |
| 7 | 0.621 | 165.6 | 18.9 | 0.71 | 15.07 | 103 | 8.56 | 1.12 | 6.02 | 0.059 | 994 | 21.4 | .011 |
| 8 | 0.698 | 149.7 | 19.12 | 0.75 | 14.72 | 90 | 9.68 | 0.97 | 6.40 | 0.071 | 885 | 23.4 | .011 |
| 9 | 0.760 | 150.1 | 16.62 | 0.78 | 13.35 | 83 | 11.01 | 0.74 | 6.26 | 0.075 | 848 | 26.9 | .009 |
| 10 | 0.660 | 159.6 | 17.31 | 0.75 | 13.8 | 107 | 8.28 | 1.09 | 5.96 | 0.055 | 998 | 23.1 | .010 |
| 11 | 0.724 | 134.0 | 17.79 | 0.73 | 13.01 | 91 | 11.18 | 0.64 | 6.27 | 0.069 | 841 | 25.5 | .007 |
| 12 | 0.804 | 134.8 | 17.99 | 0.75 | 13.38 | 88 | 10.99 | 0.63 | 6.08 | 0.069 | 828 | 27.8 | .007 |
| 13 | 0.844 | 129.9 | 17.74 | 0.76 | 13.11 | 67 | 11.66 | 0.58 | 5.7 | 0.085 | 710 | 29.4 | .009 |

TABLE 3

| Fabric | Finished Mesh (ends/CD in) | Finished Count (shutes/MD in) | Warp diameter (mm) | Weighted avg Shute diameter (mm) | Warp density | Shute density | Shed | Pick | # knuckles/ unit cell | # unit cells/in$^2$ | Fabric features or protrusions per sq inch | Warp knuckles per sq inch |
|---|---|---|---|---|---|---|---|---|---|---|---|---|
| KC-1 (ms) | 69 | 45 | 0.33 | 0.3 | 90% | 53% | 8 | 10 | 1 | 38.8 | 4.3 | 0 |
| KC-1 | 69 | 45 | 0.33 | 0.3 | 90% | 53% | 8 | 10 | 1 | 38.8 | 4.3 | 0 |
| KC-2 | 70 | 43 | 0.33 | 0.3 | 91% | 51% | 8 | 10 | 1 | 37.6 | 4.1 | 0 |
| KC-3 | 72 | 32 | 0.33 | 0.3 | 94% | 38% | 8 | 10 | 1 | 28.8 | 3.0 | 0 |
| KC-3 (ms) | 72 | 32 | 0.33 | 0.3 | 94% | 38% | 8 | 10 | 1 | 28.8 | 3.0 | 0 |
| KC-4 | 72 | 37 | 0.33 | 0.3 | 94% | 44% | 16 | 24 | 8 | 6.9 | 7.0 | 0 |
| KC-5 | 72 | 37 | 0.33 | 0.3 | 94% | 44% | 6 | 10 | 1 | 44.4 | 2.6 | 0 |
| KC-6 | 72 | 44 | 0.33 | 0.3 | 94% | 52% | 12 | 12 | 1 | 22.0 | 6.2 | 0 |
| KC-7 | 73.5 | 46 | 0.33 | 0.3 | 95% | 54% | 12 | 48 | 6 | 5.9 | 6.5 | 0 |
| KC-8 (ms) | 73 | 48 | 0.33 | 0.3 | 95% | 57% | 12 | 60 | 6 | 4.9 | 6.8 | 0 |
| KC-9 (ms) | 73 | 39 | 0.33 | 0.3 | 95% | 46% | 12 | 60 | 6 | 4.0 | 5.5 | 0 |
| KC-10 (ms) | 72 | 37 | 0.33 | 0.4 | 94% | 58% | 12 | 60 | 6 | 3.7 | 7.0 | 0 |
| KC-11 | 52 | 25 | 0.45 | 0.5 | 92% | 49% | 12 | 12 | 1 | 10.1 | 5.9 | 0 |
| KC-11 (ms) | 52 | 25 | 0.45 | 0.5 | 92% | 49% | 12 | 12 | 1 | 9.0 | 5.9 | 0 |
| KC-12 | 52 | 28 | 0.45 | 0.5 | 92% | 55% | 12 | 12 | 1 | 10.8 | 6.6 | 0 |
| KC-13 | 52 | 30 | 0.45 | 0.47 | 92% | 56% | 12 | 12 | 1 | 10.9 | 6.7 | 0 |
| KC-14 (ms) | 52 | 30.3 | 0.45 | 0.45 | 92% | 54% | 12 | 12 | 1 | 12.1 | 6.4 | 0 |
| KC-15 | 52 | 33.5 | 0.45 | 0.45 | 92% | 59% | 12 | 10 | 1 | 11.0 | 7.1 | 0 |
| KC-16 (ms) | 52 | 25.3 | 0.45 | 0.45 | 92% | 45% | 12 | 12 | 1 | 7.1 | 5.4 | 0 |

TABLE 3-continued

| Fabric | Finished Mesh (ends/CD in) | Finished Count (shutes/MD in) | Warp diameter (mm) | Weighted avg Shute diameter (mm) | Warp density | Shute density | Shed | Pick | # knuckles/ unit cell | # unit cells/in$^2$ | Fabric features or protrusions per sq inch | Warp knuckles per sq inch |
|---|---|---|---|---|---|---|---|---|---|---|---|---|
| KC-17 | 32.6 | 19.6 | 0.7 | 0.6 | 90% | 46% | 8 | 8 | 1 | 10.0 | 3.7 | 0 |
| KC-17 (ms) | 32.6 | 19.6 | 0.7 | 0.6 | 90% | 46% | 8 | 8 | 1 | 10.0 | 3.7 | 0 |
| KC-18 | 24 | 22.4 | 0.7 | 0.6 | 66% | 53% | 12 | 14 | 1 | 3.2 | 6.3 | 0 |
| KC-19 | 33.3 | 18 | 0.7 | 0.6 | 92% | 43% | 8 | 10 | 1 | 7.5 | 3.4 | 0 |
| KC-19 (ms) | 33.3 | 18 | 0.7 | 0.6 | 92% | 43% | 8 | 10 | 1 | 7.5 | 3.4 | 0 |
| KC-20 | 33.3 | 18 | 0.7 | 0.6 | 92% | 43% | 8 | 12 | 1 | 6.2 | 3.4 | 0 |
| KC-20 (ms) | 33.3 | 18 | 0.7 | 0.6 | 92% | 43% | 8 | 12 | 1 | 6.2 | 3.4 | 0 |
| KC-21 | 76.2 | 39 | 0.330 | 0.4 | 99% | 61% | 24 | 29 | 12 | 4.3 | 14.7 | 0 |

Table notes:
All fabrics measured on standard sheet side (ss) unless noted otherwise. For satin weaves like 5K, (ss) defined as side with long warp.
(ms) = machine side is defined herein as bottom side of fabric as woven.

TABLE 4

| | From top plane to Intermediate plane | | | | From top plane to pocket bottom (lowest visible yarn) | | | | | From Bearing area 30% to 60% | | |
|---|---|---|---|---|---|---|---|---|---|---|---|---|
| Fabric | Knuckle height to inter-mediate (mm) | Knuckle height to intermediate (% of warp diameter) | Knuckle height (% warp + shute diameters) | Covered surface area DTp (%) | Knuckle height (mm) | Knuckle height (% warp diameter) | Knuckle height (% warp + shute diameters) | Covered surface area DTp (%) | Void Volume/ Surface area Smmr (mm3/mm2) | Relative pocket depth (mm) | Relative pocket depth (% warp diameter) | Relative pocket depth (% warp + shute diameters) |
| KC-1 (ms) | 0.267 | 81% | 42% | 0.0% | 1.270 | 385% | 202% | 0% | | 0.508 | 154% | 81% |
| KC-1 | 0.059 | 18% | 9% | 0.0% | 1.030 | 312% | 163% | 0% | | 0.593 | 180% | 94% |
| KC-2 | 0.064 | 19% | 10% | 0.4% | 1.110 | 336% | 176% | 66% | 0.74 | 0.522 | 158% | 83% |
| KC-3 | 0.231 | 70% | 37% | 5.0% | 1.130 | 342% | 179% | 60% | 0.83 | 0.536 | 162% | 85% |
| KC-3 (ms) | 0.090 | 27% | 14% | 1.0% | 1.270 | 385% | 202% | 67% | 0.83 | 0.501 | 152% | 80% |
| KC-4 | 0.030 | 9% | 5% | 0.3% | 0.632 | 192% | 100% | 57% | 0.46 | 0.349 | 106% | 55% |
| KC-5 | 0.157 | 48% | 25% | 3.4% | 0.998 | 302% | 158% | 65% | 0.67 | 0.430 | 130% | 68% |
| KC-6 | 0.099 | 30% | 16% | 2.2% | 1.260 | 382% | 200% | 65% | 0.86 | 0.558 | 169% | 89% |
| KC-7 | 0.023 | 7% | 4% | 0.3% | 0.977 | 296% | 155% | 65% | 0.65 | 0.416 | 126% | 66% |
| KC-8 (ms) | 0.000 | 0% | 0% | 0.0% | 1.270 | 385% | 202% | 67% | 0.87 | 0.463 | 140% | 73% |
| KC-9 (ms) | 0.101 | 31% | 16% | 1.4% | 1.160 | 352% | 184% | 64% | 0.82 | 0.480 | 145% | 76% |
| KC-10 (ms) | 0.147 | 45% | 20% | 3.9% | 1.280 | 388% | 175% | 66% | 0.87 | 0.581 | 176% | 80% |
| KC-11 | 0.535 | 119% | 56% | 0.0% | 2.600 | 578% | 274% | 0% | | 1.420 | 316% | 149% |
| KC-11 (ms) | 0.362 | 80% | 38% | 0.0% | 2.620 | 582% | 276% | 0% | | 1.500 | 333% | 158% |
| KC-12 | 0.549 | 122% | 58% | 5.0% | 1.950 | 433% | 205% | 60% | | 1.280 | 284% | 135% |
| KC-13 | 0.564 | 125% | 61% | 4.5% | 1.890 | 420% | 205% | 62% | | 1.350 | 300% | 147% |
| KC-14 (ms) | 0.403 | 90% | 45% | 0.0% | 2.570 | 571% | 286% | 0% | | 1.260 | 280% | 140% |
| KC-15 | 0.079 | 17% | 9% | 0.0% | 2.426 | 539% | 270% | 0% | | 1.580 | 351% | 176% |
| KC-16 (ms) | 0.264 | 59% | 29% | 0.0% | 2.380 | 529% | 264% | 0% | | 1.340 | 298% | 149% |
| KC-17 | 0.089 | 13% | 7% | 0.0% | 2.288 | 327% | 176% | 0% | | 1.680 | 240% | 129% |
| KC-17 (ms) | 0.093 | 13% | 7% | 0.0% | 2.170 | 310% | 167% | 0% | | 1.496 | 214% | 115% |
| KC-18 | 0.370 | 53% | 28% | 0.6% | 5.319 | 760% | 409% | 55% | 0.04 | 5.290 | 756% | 407% |
| KC-19 | 0.000 | 0% | 0% | 0.0% | 2.823 | 403% | 217% | 0% | | 1.160 | 166% | 89% |
| KC-19 (ms) | 0.282 | 40% | 22% | 0.0% | 2.520 | 360% | 194% | 0% | | 1.920 | 274% | 148% |
| KC-20 | 0.148 | 21% | 11% | 0.0% | 2.563 | 366% | 197% | 0% | | 1.100 | 157% | 85% |
| KC-20 (ms) | 0.326 | 47% | 25% | 0.0% | 2.880 | 411% | 222% | 0% | | 1.810 | 259% | 139% |
| KC-21 | 0.236 | 72% | 32% | 13.0% | 0.909 | 275% | 125% | 64% | 0.63 | 0.430 | 130% | 59% |

It will be appreciated that the foregoing examples and discussion, given for purposes of illustration, are not to be construed as limiting the scope of this invention, which is defined by the following claims and all equivalents thereto.

We claim:

1. A woven papermaking fabric having a regular series of distinct depressions in the surface of the fabric that are surrounded by raised warp or shute strands, said depressions having a depth from about 1.0 to about 5.5 millimeters, an opening having a length and width from about 5 to about 20 millimeters, and a frequency of occurrence in the surface of the fabric from about 0.8 to about 3.6 depressions per square centimeter, said fabric further having a top plane containing cross-machine direction impression knuckles formed by shute strands which pass over 2 or more warp strands, said top plane containing no machine direction impression knuckles.

2. The fabric of claim 1 wherein the openings of the depressions have a length and width of from about 10 to about 15 millimeters.

3. The fabric of claim 1 wherein the depressions are offset with respect to each other when the fabric is viewed in the machine direction.

4. A woven papermaking fabric having a regular series of distinct depressions in the surface of the fabric that are surrounded by raised warp or shute strands, said depressions having a depth from about 250 to about 525 percent of the warp strand diameter, an opening having a length and width from about 5 to about 20 millimeters, and a frequency of occurrence in the surface of the fabric from about 0.8 to about 3.6 depressions per square centimeter, said fabric further having a top plane containing cross-machine direction impression knuckles formed by shute strands which pass over 2 or more warp strands, said top plane containing no machine direction impression knuckles.

5. The fabric of claim 4 wherein the depressions have an opening having a length and width of from about 10 to about 15 millimeters.

6. The fabric of claim 4 wherein the depressions are offset with respect to each other when the fabric is viewed in the machine direction.

* * * * *